US008466808B2

(12) United States Patent
Ghatak

(10) Patent No.: US 8,466,808 B2
(45) Date of Patent: Jun. 18, 2013

(54) OPTICAL PARKING GUIDE

(75) Inventor: Sudip Ghatak, East Brunswick, NJ (US)

(73) Assignee: Tracker LLC, East Brunswick, NJ (US)

( * ) Notice: Subject to any disclaimer, the term of this patent is extended or adjusted under 35 U.S.C. 154(b) by 497 days.

(21) Appl. No.: 12/823,209

(22) Filed: Jun. 25, 2010

(65) Prior Publication Data

US 2011/0316720 A1 Dec. 29, 2011

(51) Int. Cl.
*B60Q 1/48* (2006.01)

(52) U.S. Cl.
USPC ..... 340/932.2; 340/933; 340/942; 340/555; 340/425.5; 340/5.71

(58) Field of Classification Search
USPC ..... 340/932.2, 933, 942, 555, 556, 557, 340/425.5, 5.71; 180/275, 286; 701/300, 701/301
See application file for complete search history.

(56) References Cited

U.S. PATENT DOCUMENTS

| | | | | |
|---|---|---|---|---|
| 4,665,378 | A | 5/1987 | Heckethorn | |
| 4,813,758 | A | 3/1989 | Sanders | |
| 5,127,357 | A | 7/1992 | Viskovick | |
| 5,177,479 | A | 1/1993 | Cotton | |
| 5,208,586 | A * | 5/1993 | Friberg et al. | 340/932.2 |
| 5,285,205 | A | 2/1994 | White | |
| 5,945,907 | A | 8/1999 | Yaron et al. | |
| 6,154,150 | A | 11/2000 | Laubach | |
| 6,191,706 | B1 | 2/2001 | Kositkun | |
| 6,218,962 | B1 | 4/2001 | Fiene | |
| 6,853,313 | B2 | 2/2005 | Newcomer | |
| 7,021,237 | B1 | 4/2006 | Benjamin | |
| 7,049,980 | B1 | 5/2006 | Chemelewski | |
| 2008/0064278 | A1 * | 3/2008 | Oaroche | 442/59 |
| 2009/0201175 | A1 * | 8/2009 | Pankowski | 340/932.2 |
| 2010/0012678 | A1 * | 1/2010 | Gietenbruch et al. | 222/1 |
| 2011/0163894 | A1 * | 7/2011 | Grievink et al. | 340/932.2 |

* cited by examiner

*Primary Examiner* — Hung T. Nguyen

(74) *Attorney, Agent, or Firm* — Arthur Jackson; Moser Taboada

(57) ABSTRACT

An optical sensor based parking guidance system using visual indicators to guide a driver into an optimal position to park a vehicle. The optical sensors create a safe parking envelope and provide visual indicators to the driver in the event the vehicle leaves the established safe area. The invention also indicates the appropriate stopping position within a parking space.

18 Claims, 4 Drawing Sheets

OPTICAL PARKING GUIDE

FIELD OF THE INVENTION

The present invention relates to among other things, a device and method of guiding a motor vehicle into a confined space and stopping it at a set end point. The device has a sensory guidance system providing feedback indicators to help correct the vehicle positioning so that it can reach the desired position within a safe parking envelope. The device is employed to aid the driver in both entry and exit processes from the desired parking position.

BACKGROUND OF THE INVENTION

In the prior art various types of parking devices have been proposed. For example, U.S. Pat. No. 7,049,980 to Chemelewski discloses a vehicle entry detector with an indicator for a safe stopping depth but provides no aid to side-to-side guidance.

U.S. Pat. No. 7,021,237 to Benjamin discloses a parking guide using both visual and auditory indicators to show a driver when a vehicle is properly positioned in a parking space. The invention is comprised of a floor mat, walls, and bell activator among other features to facilitate the process.

U.S. Pat. No. 6,853,313 to Newcomer uses a set of light rays to help position the vehicle in the proper position.

U.S. Pat. No. 6,218,962 to Fiene uses light to help position a vehicle forward.

U.S. Pat. No. 6,191,706 to Kositkun uses a laser diode mounted with a garage door opener and a corresponding element on the vehicle dashboard to help guide the vehicle into proper position.

U.S. Pat. No. 6,154,150 to Laubach discloses a projection unit mounted above a parking position, which projects a beam of light onto the parking position. A detection unit detects the light and a motion detector actuates the projector.

U.S. Pat. No. 5,945,907 to Yaron discloses using a sensor at a fixed position to measure distance between the fixed point and parking vehicle to help guide the vehicle within a defined space or envelope. The device can also be used laterally to help measure distance in relation to walls of the garage.

U.S. Pat. No. 5,285,205 to White uses a laser that emits a beam over the path a vehicle is to take to guide the driver position into position.

U.S. Pat. No. 5,177,479 to Cotton discloses a garage entry device that provides position indication.

U.S. Pat. No. 5,127,357 to Viskovick discloses a mirror affixed adjacent a garage door which reflects the vehicles brake lights and rear bumper.

U.S. Pat. No. 4,813,758 to Sanders discloses a metal plate mounted with a fastener to a supporting surface and lateral positioning members for ensuring proper lateral vehicle positioning.

U.S. Pat. No. 4,665,378 to Heckethorn discloses a signal light downwardly in a concentrated beam to enable proper vehicle positioning.

Garage parking guides have been in use for years. Typically, garage parking guides are comprised of either physical levels, electrical connections or hanging devices that activate on visual and/or audible signals. Previous and current garage parking guides have required precise installation and adjustment for a particular vehicle, and/or driver.

The main problem with conventional garage parking guides is that the positioning a vehicle in an enclosed garage requires attention and precision. Parking a vehicle in a confined space requires, but is not limited to, the following conditions:

- Vehicle must be parked to allow clearance for the garage door to close. The clearance should be at a minimum.
- Vehicle should be parked to permit maximum use of garage space for storage of tools, lawn equipment and other household items.
- Driver should allow space for movement around the vehicle.
- Driver must also avoid hitting internal walls and other objects in the garage that may lead to damage of structure, equipment and/or vehicle. Particular concern needs to be placed in order to avoid damage to side view mirrors.
- Vehicle should able to enter and exit garage with ease and meet the conditions stated above.
- Driver should be able to employ the device with and without an automatic garage door opener.
- Vehicle should be aligned to not hit mirrors on entry or reverse.

A simple but effective garage guide is needed to provide the driver with a signal to let the driver know when he or she has reached the proper location in which to park. The guide should be universal so that it will work for any size vehicle in any size garage. As long as there is physical space to park the vehicle in the garage, the guide should enable accurate parking each and every time. The invention should have a stopping guide to signal the driver the proper position has been reached to meet conditions stated above. The guide should provide appropriate feedback to the driver during the entire parking process to achieve the desired outcome and park with confidence. The guide should be small in profile as possible to avoid being a tripping hazard, an eyesore and reduce the amount of consumed space. The guide should be easy to assemble requiring no tools. The guide should be inexpensive to manufacture and purchase to benefit as many drivers as possible. The guide should be easy to maintain and durable. The guide should be of modular design such that all parts should be replaceable.

Conventional garage parking guides for the most part with the exception that of Benjamin (U.S. Pat. No. 7,021,237) are better suited as stopping guides which help the driver stop the vehicle in a designated parking space versus actually guiding the vehicle into the garage—a much more difficult problem. Many use lasers or beams of light which are difficult to see during the day and therefore generally effective only at night. Additionally, most support only the entry process of getting the vehicle into position and provide little or no support to exiting process of the vehicle from the parking position. Conventional garage parking guides have physical signal producing devices that interfere with use of garage space. They can be unsightly and require high maintenance. As in the case of Benjamin (U.S. Pat. No. 7,021,237), they consume too much space and pose a tripping hazard with the raised walls. The audible signal devices are often irritating to the household and neighborhood, and they are expensive.

This invention, in general, to devices which assist in parking a vehicle in a garage, and, in particular, to optical sensors, reflectors, battery box/controller, switch, visual indicators and stopping guide for proper placement of a vehicle in a garage or other parking space.

SUMMARY OF THE INVENTION

The present invention is directed to a parking guide having visual indicators to guide the driver into a parking space and/or garage. The indicators only provide feedback to the driver when the vehicle is no longer in the safe parking envelope upon entry or exit. The invention also has a stopping guide to signal the driver to stop the vehicle when the vehicle is properly positioned in a parking space.

In certain embodiments, the invention provides a new and improved parking guide.

In certain embodiments, the invention provides a new and improved parking guide, which has visual parking indicators.

In certain embodiments, the invention provides a new and improved parking guide, which can be easily and quickly assembled and used for any size vehicle in any size garage assuming there is physical space to park the vehicle in the garage.

In certain embodiments, the invention provides a new and improved parking guide that both guides the driver into the garage and stops the vehicle in the appropriate place in a parking space.

In certain embodiments, the invention provides a vehicle parking guide that signals to a vehicle driver comprising a pair of optical sensors (an emitter and receiver combination) and corresponding reflector elements (the sensors and reflectors are "optical elements"), a switch, a battery box/controller and light indicator box. The pair of optical sensors and reflectors creates a safe parking envelope or box to position the vehicle. As long as the driver does not veer out of the safe parking envelope no feedback will be provided. In the event the driver extends out of the safe parking envelope a sided indicator (such as a light indicator signal) will illuminate informing the driver which direction he has erroneously driven. At which point the driver will need to correct position by driving in the opposite direction. This occurs for both vehicle entry and exit. The invention provides, among other things, a vehicle parking guide that signals to a vehicle driver only when the driver improperly drives out of the designated safe parking envelope comprising of a pair of photoelectric sensors, corresponding reflectors to create the beams of light establishing the safe parking envelope, a switch, light box with indicators (left and right) providing feedback in the direction erroneously driven, battery box/controller which can contain the batteries and wiring elements and a speed bump serving as a stopping guide when the vehicle reaches position.

In certain embodiments, the invention provides a method of parking using the parking guide, comprising of aligning the vehicle as one would normally do and receive feedback in the form of light indicators informing the driver when he has left the safe parking area established by the parking guide and the direction of the error.

In certain embodiments, the invention provides a method of reversing a car out of a parking space while avoiding obstacles using the parking guide with optical sensors providing feedback to the driver when the driver has erroneously left the safe parking envelope established by the parking guide and the direction of the error.

In certain embodiments, the invention integrates with the existing garage door both with and without an automatic garage door opener. A vehicle parking system comprising: two guide sets comprising an optical sensor module and a reflector module, wherein the modules have a low profile allowing them to be run over by the vehicle, the guides adapted provide an optical pathway defining a lateral outer boundary for vehicle movement; a sided indicator of left or right lateral straying of the vehicle; and a controller adapted to communicate with the sensor modules and with the sided indicator; wherein the controller is adapted to communicate a breach of either of the two lateral outer boundaries indicated by the respective guides to the sided indicator to provide the respective lateral stray indicator. The modules can have adhesive pads adapted to adhere the modules to a base of a parking area. The vehicle parking system, wherein the sided indicator emits distinct visual or audio signals indicative of left or right stray. The vehicle parking system, further comprising garage-open sensor adapted to communicate with the controller, wherein the controller acts to supply power to the optical sensors when the garage is open. The vehicle parking system, further comprising one or more battery slots for holding batteries for powering the vehicle parking guide. The vehicle parking system, wherein the sided indicator is a light indicator box with a left stray indicating panel and a right stray indicating panel. The vehicle parking system, further comprising an additional guide set, the guide set adapted provide an optical pathway defining a rear boundary for vehicle movement, wherein the sided indicator further indicates reaching a rear boundary, and the controller operates to communicate a breach of the rear boundary indicated by the rear guide set to the sided indicator to provide the rear boundary indicator. The vehicle parking system, wherein the modules have an upper trough for the optical pathways such that the optical features can sit within the modules protected from a straying vehicle. The vehicle parking system, further comprising a bump adapted to indicate a rear boundary. A method of parking a vehicle comprising: providing the parking system; providing the guide sets on the two lateral sides of a parking space to define a safe parking envelope; beginning to move the vehicle into the parking space; and as needed, adjusting the movement of the vehicle as indicated by the sided indicator.

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

These and other features and advantages of embodiments the present invention will be fully apparent from the following description, when taken in connection with the included drawings.

DETAILED DESCRIPTION OF THE INVENTION

Figure 1:
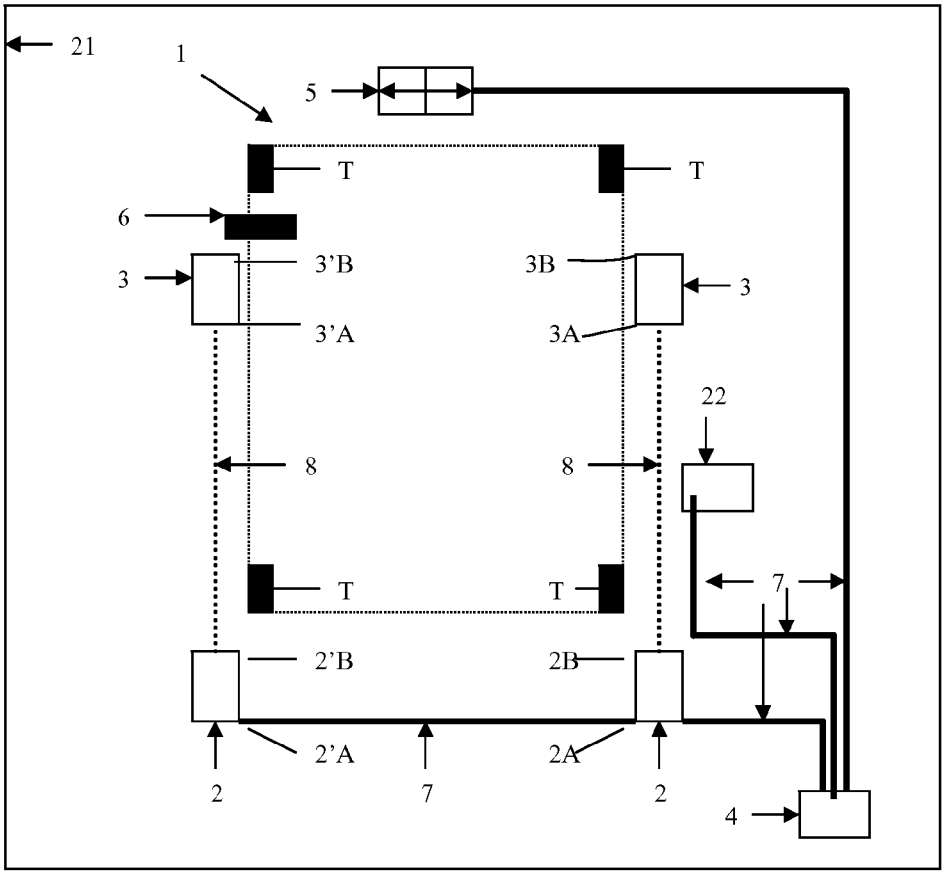
FIG. 1 is a perspective view of the present invention.
Figure 2:
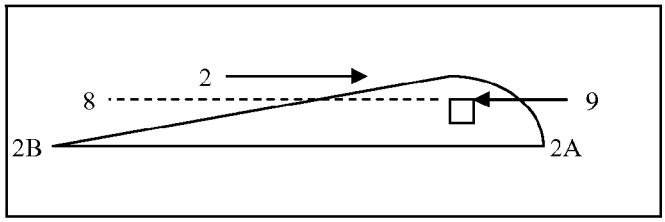
FIG. 2 is a detailed side view of the photoelectric sensor, protective molding and sensor indicator window.
Figure 3:
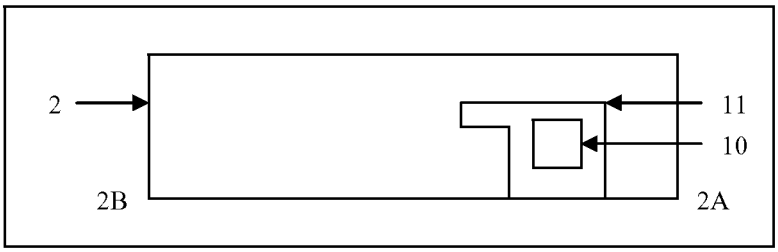
FIG. 3 is a detailed bottom view of the photoelectric sensor, protective molding and photoelectric sensor housing.
Figure 4:
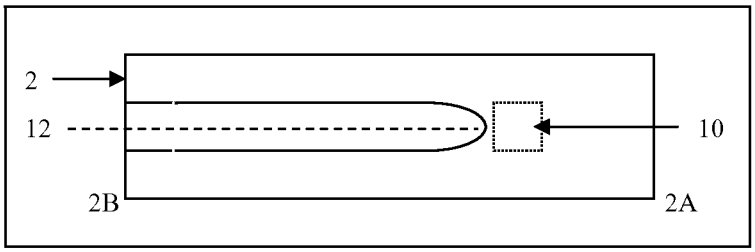
FIG. 4 is a detailed top view of the photoelectric sensor, protective molding and light pathway.
Figure 5:
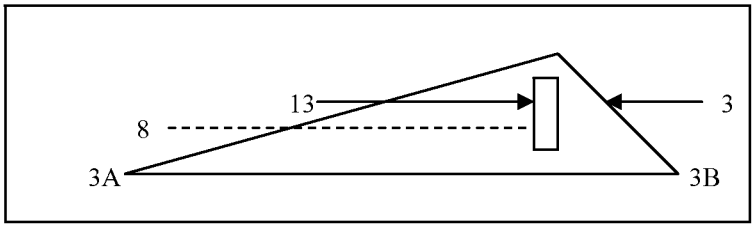
FIG. 5 is a detailed side view of the reflector and protective molding.
Figure 6:
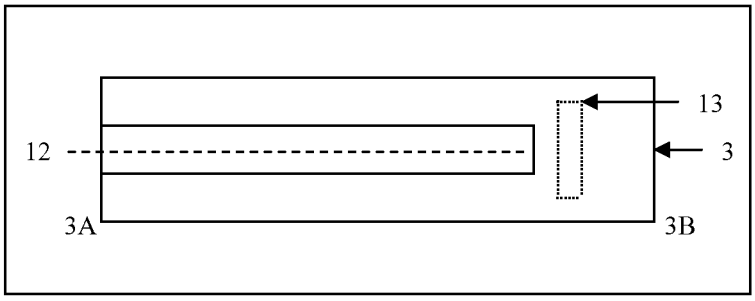
FIG. 6 is a detailed top view of the reflector, protective molding and light pathway.
Figure 7:
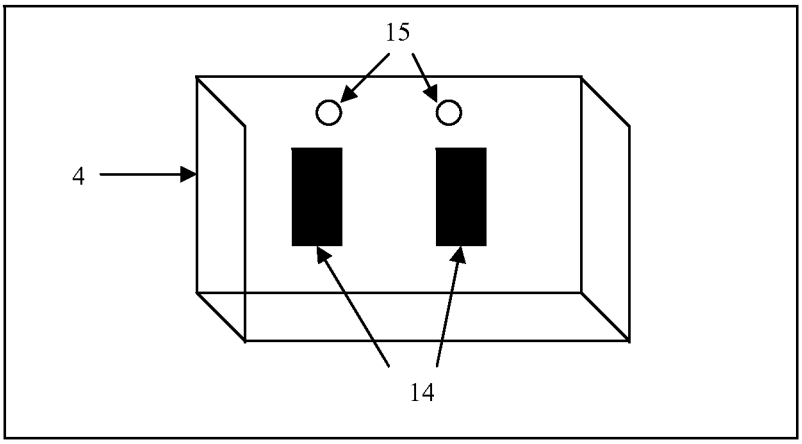
FIG. 7 is a detailed inside view of the battery box including batteries and wall mounting holes.
Figure 8:
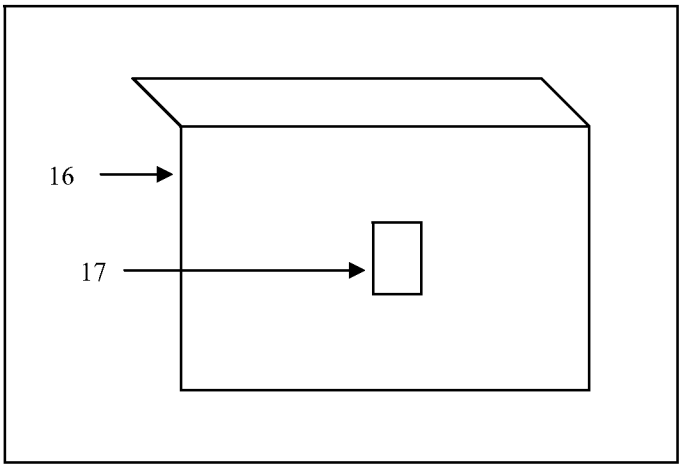
FIG. 8 is a detailed outside view of the battery box cover and view window.
Figure 9:
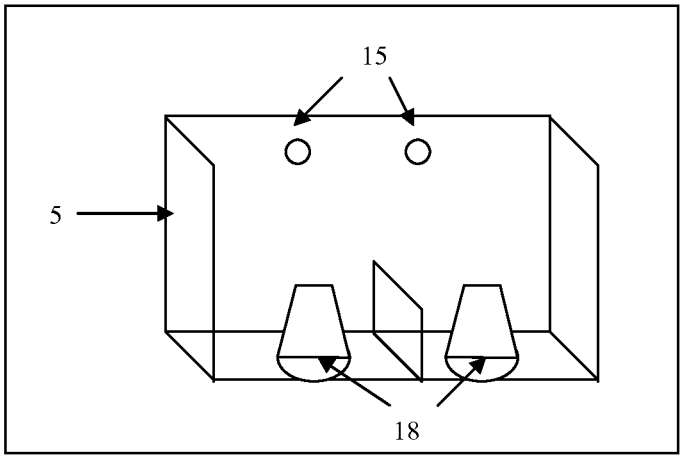
FIG. 9 is a detailed inside view of the light box including lights and wall mounting holes.
Figure 10:
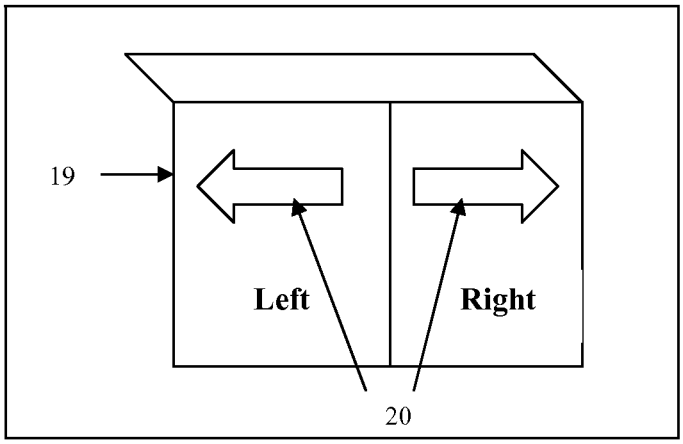
FIG. 10 is a detailed outside view of the light box including directional indicators—left and right.

Referring now to the drawings in greater detail, FIG. 1 shows a perspective view of an exemplary parking guide of the present invention 1. The parking guide is comprised of five basic components: photoelectric sensors 10 housed in protective moldings 2, reflectors 13 housed in protective moldings 3, battery box/controller 4, light box 5 and switch 22. The layout of the parking guide on the garage floor 21 is illustrated in FIG. 1. The adjustable width formed by the pair of photoelectric sensors 10 and reflectors 13 can be adjusted to fit any size vehicle in any size garage. For practicality purposes only two pairs of sensors and reflectors are described (left and right), however, additional sensor pairs can be employed to provide the top and bottom segments of the safe parking envelope completing the four sided box. Additionally the present embodiment employs photoelectric sensors, however, other sensors can be used including laser, light, sound, force among others to achieve the same benefit. The wire 7 is used to connect the sensors to the battery box/controller 4 and corresponding indicators on the light box 5 along with the switch 22. Though the present embodiment employs wires to connect the elements together, however, wireless elements including sensors and reflectors ("optical elements", indicators (light and sound), battery box/controller and switch can be incorporated to achieve the same benefit. Each sensor 10 emits a light beam 8 when in it is alignment with the reflector 13. The speed bump 6 is employed to aid the driver in indicating the stopping position. When the vehicle arrives at the proper stopping point the tires T will be in the noted position. The tire T will hit the bump indicating to the driver to stop once over the bump or when the tire is in a trough defined by the bump.

The parking guide is comprised of a pair of photoelectric sensors 10 and corresponding reflectors 13 which emit a pair of light beams 8 serving as the left and right boundaries of the safe parking envelope. The parking guide includes a battery box/controller 4, which provides power to both the sensors and lights. The light box 5 has both left and right indicator arrows signaling the driver which direction he has erroneously driven. The device also has a speed bump 6 to help stop the vehicle in the desired stopping position.

The driver initially places a first photoelectric sensor 10 inside the photoelectric sensor protective molding 2 and repeats the process for a second sensor 10. The driver then places a first reflector 13 inside the reflector protective molding 3 and repeats the process for a second reflector 13. The driver then aligns the photoelectric sensor 10 with the reflector 13 to ensure a continuous light beam 8 that is indicated by detecting the appropriate color light in the sensor indicator window 9. The driver then places each sensor and reflector pair in the appropriate position on the garage floor to establish the boundaries of the safe parking envelope given the size of the vehicle, garage walls and desired stopping position. After which the driver places the speed bump 6 in the appropriate stopping position. The driver then mounts the battery box 4 on the wall and the light box 5 on the wall in the desired position for best viewing using the wall mounting holes 15 provided in the battery box/controller 4 and light box 5. The driver then connects the switch 22 to the garage door. The driver installs the batteries 14 in the battery box 4 and places the battery box cover 16 on the battery box 4. The driver can check inside the battery box for correct battery position by looking through the view window 17. The driver installs the light bulbs 18 in the light box 5 and places the light box cover 19 on the light box 5. Finally the driver checks the operation of the parking guide 1 by manually breaking each of the light beams 8 in a discontinuous manner and ensuring the appropriate direction indicator arrow 20 is illuminated. The driver will also check to ensure the direction indicator arrow 20 turns off when the light beam returns to continuous mode.

The driver first opens the garage door either manually or with an automatic garage door opener. The garage door activates the switch 22 that in certain embodiments operates to turn the parking guide 1 on. As the driver approaches the garage he aligns his vehicle to the garage opening, as he would do normally. As he enters the garage the device will signal if the vehicle is out of the established safe parking envelope. The direction indicator 20 will light up in the direction the driver has driven erroneously. For example if he goes too far left the left indicator will light up since left light beam would have been disrupted signaling the driver to correct in the opposite direction, in this case by moving right. Conversely, if the he goes too far right the right indicator will light up since the right light beam would have been disrupted signaling the driver to correct in the opposite direction, in this situation by moving left. Once the driver makes the appropriate correction the light beam becomes continuous once again and the respective direction indicator 20 will turn off. The driver then continues the parking process. The parking guide 1 will engage at every instance the driver leaves the safe parking envelope regardless of the number of errors. The driver will come to a stop once crossing the speed bump 6 that was previously positioned at the desired stopping point. Finally the driver will close the garage door either manually or automatically, which will disengage the switch 22 turning the device off.

The driver can easily exit the garage simply by following the process in reverse. The parking guide 1 will engage if the driver has erroneously moved laterally either left or right out of the safe parking envelope in the process of exiting. The direction indicator 20 will engage identifying the direction of the error either left or right. Exiting the garage though not as difficult as entry can be challenging due to the tight spaces involved.

It is envisioned that the driver would use one unit comprising of a pair of photoelectric sensors 10, a pair of reflectors 13, a pair of photoelectric sensor protective moldings 2, a pair of reflector protective moldings 3, a battery box/controller 4, a light box 5, a switch 22 and a speed bump 6 for any of a wide range of vehicles. The invention's significant differentiator is the creation of the safe parking box or envelope that is not present in other designs. The invention uses light indicators for the purposes of signaling, however, alternative indicators can be employed such as sound and voice directions among others. The system can be extended, using same described above, to include additional sensors to further enclose the safe parking box or envelope with the deployment of a third or fourth sensor to completely enclose the top and bottom boundaries of the safe parking box.

The invention is ambidextrous in design so can be rotated to either side of the garage to minimize space consumption and be placed nearest to the garage entrance. The parking guide 1 can also be employed in two, three or more car garages simply by installing the components in the available space. The embodiment described here is for use on the right side or passenger side of the vehicle. By rotating the invention it can be used on the left side or driver side of the vehicle using the same entry and exit process. As the vehicle is rectangular in shape either placement will result in the same benefit. The left side orientation has not been shown to avoid any confusion.

A battery box/controller 4 is included in the present invention to control the sensors, light, and supply power when the device is activated. However, control switching could be integrated in a more complex circuitry to enable additional features including the additional indicators mentioned above along with additional sensors described above.

The protective sensor and reflector moldings are designed in a low profile manner enabling the vehicle to run over it if necessary. Though the driver should not be driving over any of the protective moldings on a regular basis the invention does provide additional protection in the worst-case scenario. The low profile design reduces space consumed on the garage floor and minimizes tripping issues.

Definitions

The following terms shall have, for the purposes of this application, the respective meanings set forth below.

Motor Vehicle Categories

Vehicle class can categorize certain motor vehicles. The following classes shall be defined consistent with how the classifications were used by the Insurance Institute for Highway Safety for 2010 vehicles: Large Luxury Cars, Midsize Luxury Cars, Large Family Cars, Midsize Moderately Priced Cars, Midsize Inexpensive Cars, Small Cars, Large SUVs, Midsize SUVs, Small SUVs, Large Pickups, Small Pickups, and Passenger Vans. The parking guide can be used with any of these types of vehicles.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed:

1. A vehicle parking system comprising:

two guide sets comprising an optical sensor module and a reflector module, wherein the modules have a low profile allowing them to be run over by the vehicle, each vehicle parking guide set adapted provide an optical pathway defining a lateral outer boundary for vehicle movement;

a sided indicator of left or right lateral straying of the vehicle; and a controller adapted to communicate with the sensor modules and with the sided indicator;

wherein the controller is adapted to communicate a breach of either of two lateral outer boundaries indicated by the respective vehicle parking guides to the sided indicator to provide the respective lateral stray indicator.

2. The vehicle parking system of claim 1, wherein the sided indicator emits distinct visual or audio signals indicative of left or right stray.

3. The vehicle parking system of claim 1, further comprising garage-open sensor adapted to communicate with the controller, wherein the controller acts to supply power to the optical sensors when the garage is open.

4. The vehicle parking system of claim 1, further comprising one or more battery slots for holding batteries for powering the vehicle parking guide.

5. The vehicle parking system of claim 1, wherein the sided indicator is a light indicator box with a left stray indicating panel and a right stray indicating panel.

6. The vehicle parking system of claim 1, further comprising an additional guide set, the guide set adapted provide an optical pathway defining a rear boundary for vehicle movement, wherein the sided indicator further indicates reaching a rear boundary, and the controller operates to communicate a breach of the rear boundary indicated by the rear guide set to the sided indicator to provide the rear boundary indicator.

7. The vehicle parking system of claim 1, wherein the modules have an upper trough for the optical pathways such that the optical features can sit within the modules protected from a straying vehicle.

8. The vehicle parking system of claim 1, further comprising a bump adapted to indicate a rear boundary.

9. A method of parking a vehicle comprising:

providing the parking system of claim 1;

providing the guide sets on the two lateral sides of a parking space to define a safe parking envelope;

beginning to move the vehicle into the parking space; and as needed, adjusting the movement of the vehicle as indicated by the sided indicator.

10. The method of parking of claim 9, wherein the sided indicator emits distinct visual or audio signals indicative of left or right stray.

11. The method of parking of claim 9, wherein the provided parking system further comprises garage-open sensor adapted to communicate with the controller, wherein the controller acts to supply power to the optical sensors when the garage is open, and wherein the method further comprises opening the garage door prior to beginning to move the vehicle into the parking space.

12. The method of parking of claim 9, wherein the sided indicator is a light indicator box with a left stray indicating panel and a right stray indicating panel.

13. The method of parking of claim 9, wherein the provided parking system further comprises an additional guide set, the guide set adapted provide an optical pathway defining a rear boundary for vehicle movement, wherein the sided indicator further indicates reaching a rear boundary, and the controller operates to communicate a breach of the rear boundary indicated by the rear guide set to the sided indicator to provide the rear boundary indicator, and wherein the method further comprises moving the car into the parking space until the rear boundary indicator is activated.

14. The method of parking of claim 9, wherein the modules of the provided parking system have an upper trough for the optical pathways such that the optical features can sit within the modules protected from a straying vehicle.

15. The method of parking of claim 9, wherein the provided parking system further comprises a bump adapted to indicate a rear boundary, and wherein the method further comprises moving the car into the parking space until the rear boundary is indicated by a bump of the vehicle.

16. A method of parking a vehicle comprising:

providing the parking system of claim 1;

providing the guide sets on the two lateral sides of a parking space to define a safe parking envelope;

providing the vehicle within the safe parking envelope beginning to move the vehicle out of the parking space; and as needed, adjusting the movement of the vehicle as indicated by the sided indicator.

17. A vehicle parking guide set comprising an optical sensor (an electronic emitter and receiver combination) module and a reflector module, wherein the modules have protective moldings and a low profile allowing them to be run over by a vehicle, each vehicle parking guide adapted provide an optical pathway defining an outer lateral boundary for vehicle movement, wherein the modules have an upper trough for the optical pathways such that the optical features, while providing the optical pathway, can sit within the modules protected from a straying vehicle.

18. A guide set kit comprising:

the guide set of claim 17; and adhesive pads adapted to adhere the modules to a base of a parking area.

* * * * *